US007324650B2

(12) United States Patent
Fischer et al.

(10) Patent No.: US 7,324,650 B2
(45) Date of Patent: Jan. 29, 2008

(54) HEARING AID DEVICE WITH AUTOMATIC SITUATION RECOGNITION

(75) Inventors: Eghart Fischer, Schwabach (DE); Volkmar Hamacher, Würselen (DE); Thomas Hies, Erlangen (DE); Thomas Hopf, Nürnbnerg (DE); Frank Wagner, Nürnberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 132 days.

(21) Appl. No.: 10/636,048

(22) Filed: Aug. 7, 2003

(65) Prior Publication Data

US 2004/0066945 A1 Apr. 8, 2004

(30) Foreign Application Priority Data

Aug. 7, 2002 (DE) ..... 102 36 167

(51) Int. Cl.
*H04R 25/00* (2006.01)

(52) U.S. Cl. ..... 381/314; 381/312

(58) Field of Classification Search ..... 381/312, 381/315, 316–317, 320–321, 314
See application file for complete search history.

(56) References Cited

U.S. PATENT DOCUMENTS 5,909,497 A * 6/1999 Alexandrescu ..... 381/312
2002/0044669 A1 4/2002 Meyer et al.

FOREIGN PATENT DOCUMENTS

DE 100 48 341 4/2002
EP 0 064 042 11/1982

* cited by examiner

*Primary Examiner*—Curtis Kuntz
*Assistant Examiner*—Phylesha L Dabney
(74) *Attorney, Agent, or Firm*—Schiff Hardin LLP

(57) ABSTRACT

The correct recognition of the auditory situation "television" often poses a problem for hearing aid devices with automatic situation recognition, since a plurality of real situations are simulated by the television audio signal. To correctly recognize the situation "television", the invention therefore provides to detect a line signal with a particular line signal frequency output by the television device, and given the existence of such a line signal to automatically implement the auditory situation "television".

13 Claims, 2 Drawing Sheets

HEARING AID DEVICE WITH AUTOMATIC SITUATION RECOGNITION

BACKGROUND OF THE INVENTION

1. Field of the Invention

The invention concerns a hearing aid device with at least one input transducer to acquire an input signal and transduce it into an electrical signal, a signal processing unit to process and amplify the electrical signal, and an output transducer to transduce the processed electrical signal into an acoustic or mechanical output signal, whereby the signal processor in the hearing aid device can be adapted to different auditory situations via at least one adjustable parameter.

2. Description of the Related Art

An auditory situation in which the bulk of hearing aid users find themselves almost daily is the auditory situation in front of the television. This situation poses a particular problem for automatic classification algorithms to detect an auditory situation, since, for example, reproduced situations in the television program with the auditory situation "speech in the static noise" or "static noise" are, in this case wanted signals, since the hearing aid user would like to completely hear the television audio signal, while the same situation in real life must be classified as an auditory situation with static noise.

A programmable hearing aid with a signal processor is known from European patent document EP 0 064 042 A1 that can be adapted automatically or by the hearing aid user to different auditory situations. Additionally, different parameters to adapt the signal processor to different auditory situations are deposited in a storage, that if required can be retrieved and influence the signal processor in the hearing aid device. Special measures to automatically recognize the auditory situation "television" do not arise from the cited document.

A hearing aid device is known from German patent document DE 100 48 341 C1 that recognizes, for automatically selecting an auditory program, whether it is in the vicinity of an external transmitter. The transmitter generates a transmitter-specific signal, such that an assignment of different transmitters can ensue. Such a transmitter of this type is, for example, installed in the television device of the hearing aid user and coupled with its on/off switch. When the television device is turned on, the transmitter is also active and the hearing aid device automatically switches to the auditory program "television" in the vicinity of the switched-on television device.

SUMMARY OF THE INVENTION

The object of the present invention is to provide a hearing aid device that reliably automatically recognizes the auditory situation "television" without an external auxiliary device attached to a television.

This object is achieved by a hearing aid device with at least one input transducer to acquire an input signal and transduce it into an electrical signal, a signal processing unit to process and amplify the electrical signal, and an output transducer to transduce the processed electrical signals into an acoustic or mechanical output signal, whereby the signal processor in the hearing aid device can be adapted to different auditory situations by at least one adjustable parameter, in that a line signal output by a screen device can be detected by the hearing aid device, and the parameter can be automatically adjusted depending on this line signal.

DESCRIPTION OF THE DRAWING

The invention is explained in more detail using exemplary embodiments.

DETAILED DESCRIPTION OF THE PREFERRED EMBODIMENTS

Figure 1:
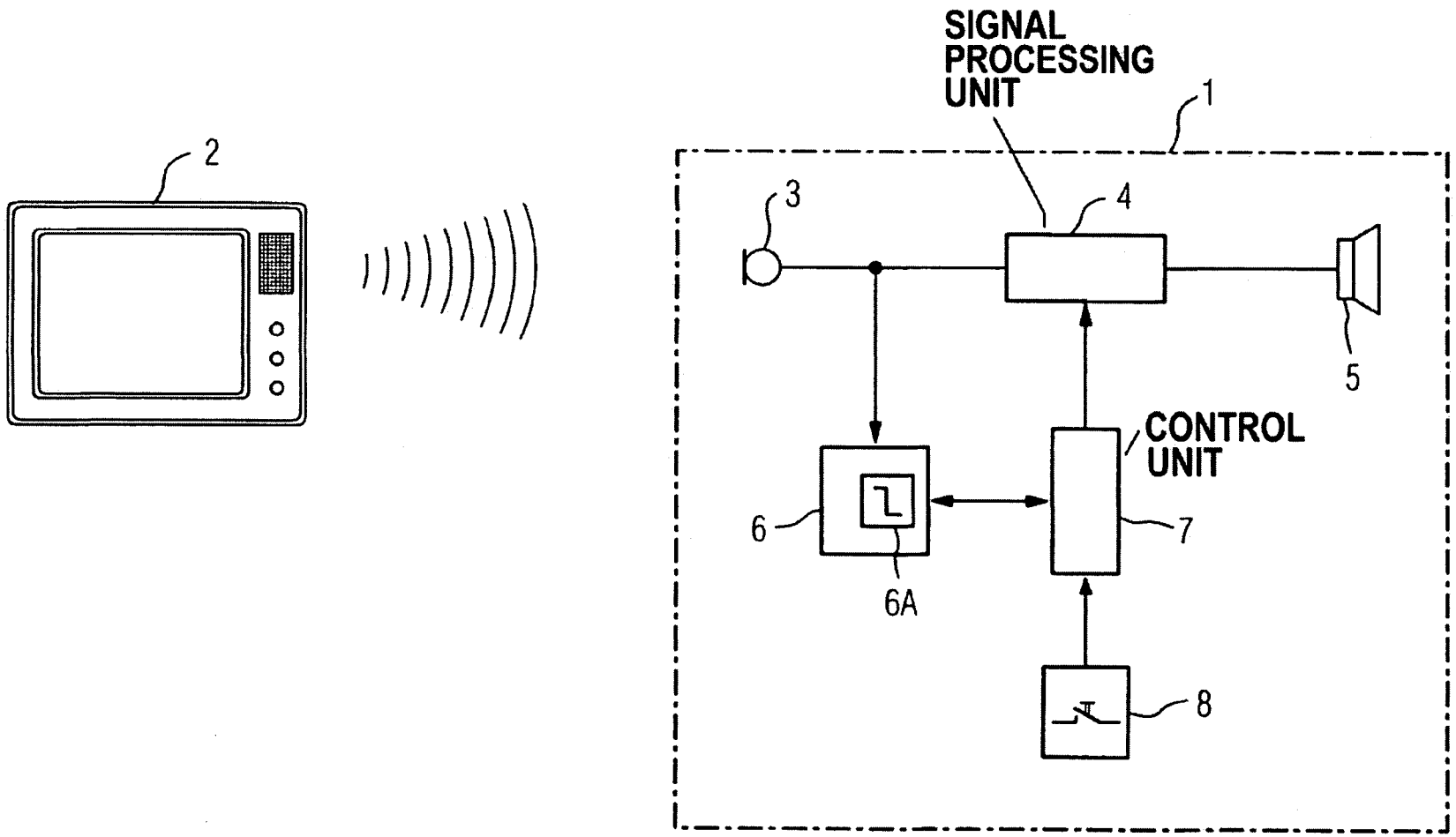
FIG. 1 shows a simplified block diagram of a hearing aid device according to an embodiment of the invention in immediate proximity to a television.

In screen devices, in particular television devices with a conventional image tube, an image to be displayed is arranged line by line. Depending on the refresh rate and the number of lines that can be displayed on the screen device, an electron beam generated in the image tube is deflected by a line signal with a particular line signal frequency. Given a television device according to the widely-used PAL standard, the line signal frequency of the line signal us, for example, 15.625 KHz. The invention is not limited to the use of the PAL standard for television devices, however. Any of the world television standards could be utilized, including, but not limited to those identified in the following table:

TABLE

| Various World Television Standards | |
|---|---|
| NTSC - National Television Systems Committee | Line Frequency 15.734 kHz<br>Scanning Lines 525<br>Field Frequency 60 Hz<br>Color Signal Modulation System Suppressed Quadralure Modulation System<br>Color Signal Frequency 3.579545 MHz<br>Burst Signal Phase settled |
| PAL - Phase Alternation Line | Line Frequency 15.734 kHz<br>Scanning Lines 625<br>Field Frequency 60 Hz<br>Color Signal Modulation System Suppressed Quadralure Modulation System<br>Color Signal Frequency 4.433619 MHz<br>Burst Signal Inversion by 1 H |
| PAL M - Phase Alternation Line - M | Line Frequency 15.734 kHz<br>Scanning Lines 525<br>Field Frequency 60 Hz<br>Color Signal Modulation System Suppressed Quadralure Modulation System<br>Color Signal Frequency 3.575311 MHz<br>Burst Signal Inversion by 1 H |
| SECAM - Sequential Couleur a Memoire | Line Frequency 15.625 kHz<br>Scanning Lines 625<br>Field Frequency 50 Hz<br>Color Signal Modulation System FM Conversion System<br>Color Signal Frequency 4.40625 MHz/4.250 MHz<br>Burst Signal Phase settled |

To generate the line signal, a line transformer is typically used that, in addition to the electrical line signal, also emits an acoustic line signal with the same signal frequency. This line signal is audible in the vicinity of a television device. In an embodiment of the invention, only this acoustic signal emitted by the line transformer can be acquired by a microphone of the hearing aid device and detected in a signal detector.

Likewise, it is however also possible to detect an electromagnetic signal emitted by the line transformer via an appropriate detector (for example, a coil in connection with an evaluation electronic assembly). The signal strength of a detected signal may subsequently be compared with a threshold, such that the auditory situation "television" is only determined in the immediate vicinity of a screen device.

If the auditory situation "television" has been automatically recognized according to the invention, parameters to control the signal processor inside the hearing aid device may be adjusted corresponding to this recognized auditory situation. For example, algorithms to relieve static noise can be switched off, since an "unwanted signal" comprised in the television audio signal (for example, background noise) during a dialogue represents in this particular case a wanted signal, that in the same situation in real life only represents a noise signal and should have been suppressed.

The invention is not limited solely to the use of "line frequency", but rather can include any other characteristic frequency emitted by a device. In an embodiment, the frequency detected would be one in which the signal would enter the hearing aid via the input transducer that receives the audio signal, however, it is also possible to include other receiving transducers as well. The input transducer could be a transducer that responds to audio signals, or it could be configured to respond to a broader frequency range.

An embodiment of the invention provides that the threshold with which an detected line signal is compared can be adjusted. The proximity to the television device can be adjusted in that the automatic situation recognition activates and the auditory situation "television" in the hearing aid is adjusted.

In another embodiment of the invention, the frequency that the line signal must comprise in order to be recognized as such can also be adjusted. Furthermore, in addition to an exact value for this frequency, a frequency interval can also be emitted. The detector can be adapted to different television standards that operate with different line frequencies. Furthermore, an adaptation to other screen devices, for example computer monitors, is also thereby possible. In these, the resolution, and thereby the number of lines as well as the refresh rate, can typically be adjusted. A plurality of possible line signal frequencies for a monitor result therefrom. The detector in the hearing aid device can then advantageously be adjusted to the particular line signal of the monitor typically used by the hearing aid device user. The invention can also be utilized wherever such signal frequencies are detectable, and is not limited solely to the use of display devices.

In an embodiment of the invention, the hearing aid device may switch back to the original adjusted auditory program that was active before the detection of the auditory situation "television" as soon as the line signal can no longer be detected by the hearing aid device, or the signal strength of the line signal detected by the hearing aid device falls below a preferably adjustable threshold.

The invention can be applied in all known hearing aid device types, for example, in hearing aid devices worn behind the ear, hearing aid devices worn in the ear, implantable hearing aid devices, or pocket hearing aid devices. Furthermore, the hearing aid device according to the invention can also be part of a hearing aid system comprising a plurality of devices to for the care of a person hard of hearing, for example part of a hearing aid system with two hearing aid devices worn on the head for binaural care, or part of a hearing aid system comprised of a device that can be worn on the head and a processor unit that can be worn on the body.

Referring to FIG. 1, in the auditory situation shown in the exemplary embodiment, a hearing aid device 1 is located in immediate proximity to a television device 2. The television device 2 may be operated according to, e.g., the PAL television standard, such that a line signal with a line signal frequency of 15.625 KHz is generated by the internal line transformer of the television device 2 (appertaining variants that utilize other monitor or signal-producing devices can be easily adapted). An acoustic signal with the same signal frequency that can be detected in the immediate vicinity of the television device 2 is also output by the line transformer.

The hearing aid device 1 comprises a microphone 3 to acquire an acoustic input signal and transduce it into an electrical signal. The electrical input signal is processed in a signal processing unit 4 and amplified depending on the signal frequency before it is retransduced into an acoustic signal and output by the earpiece 5.

The hearing aid device 1 according to the exemplary embodiment furthermore comprises a signal analysis device to analyze the electrical signal generated by the microphone. In particular, the electrical input signal is analyzed to that effect in the signal processing unit as to whether a signal with a signal frequency of 15.625 KHz is comprised therein.

If such a signal is continually detected for a certain duration, the signal strength of this signal is compared with a (preferably adjustable) threshold using a threshold element 6A within the signal analysis device 6. If the signal strength of a recognized signal with the aforementioned line signal frequency is above the threshold, the auditory situation is thereby classified as "television". A signal may then be transmitted to a control unit 7 that upon receipt automatically adjusts parameters to control the signal processor in the signal processing unit 4 to adapt to this auditory situation. As soon as the line signal can no longer be recognized by the hearing aid device, or the signal strength of a recognized line signal once again falls below the threshold, the values of the appertaining parameter implemented before the detection of the auditory situation "television" by the hearing aid device are again implemented.

Figure 2:
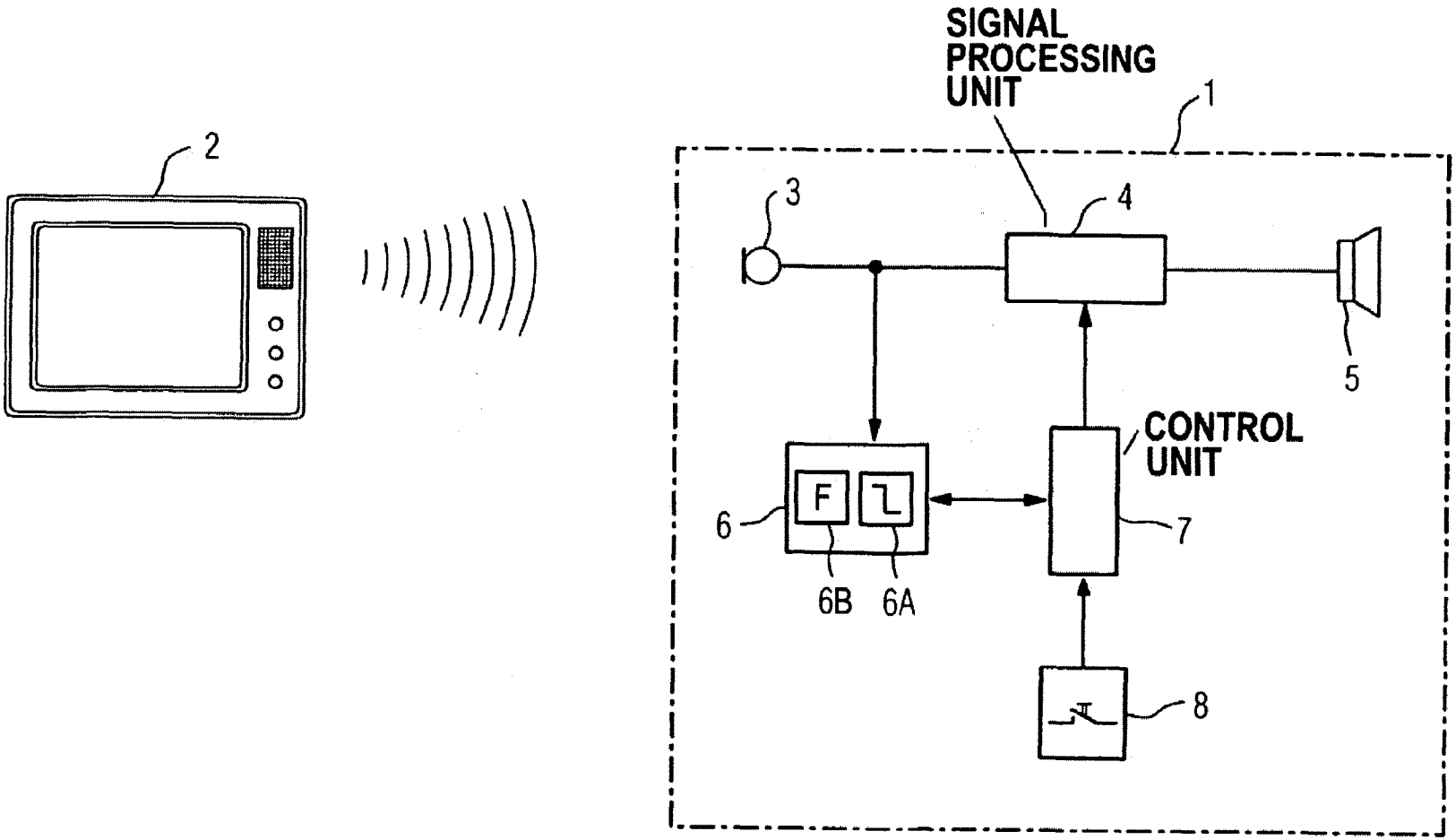
FIG. 2 shows a simplified block diagram of a hearing aid device with a frequency element in the signal analysis device.

FIG. 2 shows an embodiment wherein the signal analysis device 6 comprises a frequency element 6B that can be adapted to different television standards that operate with different line or other characteristic frequencies.

In addition, the control unit 7 in the hearing aid device according to the exemplary embodiment is preferably connected to an operator element 8, for example a button or switch, by which the hearing aid device 1 can also be manually adapted to different auditory situations.

In summary it is held that the correct recognition of the auditory situation "television" often poses a problem for hearing aid devices with automatic situation recognition, since a plurality of different real situations are simulated by the television audio signal. To correctly recognize the situation "television", an embodiment of the invention therefore provides to detect a line signal output by the television device with a particular line signal frequency and, given the existence of such a line signal, to automatically adjust implement the auditory situation "television" (or other appertaining classification for the situation).

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps.

Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming or scripting language such as C, C++, Java, assembler, or the like, with the various algorithms being implemented with any combination of data structures, objects, processes, routines or other programming elements. Furthermore, the present invention could employ any number of conventional techniques for electronics configuration, signal processing and/or control, data processing and the like.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

REFERENCE LIST

| | |
|---|---|
| 1 | hearing aid device |
| 2 | television device |
| 3 | microphone |
| 4 | signal processing unit |
| 5 | earpiece |
| 6 | signal analysis device |
| 6A | threshold element |
| 7 | control unit |
| 8 | operator element |

What is claimed is:

1. A hearing aid device, comprising:

at least one input transducer configured to acquire an input signal and transduce it into an electrical signal;

a detector for detecting a line signal that deflects an electron beam generated in an image tube output by a screen device that is devoid of any information encoded specifically for the hearing aid device;

a signal processing unit configured to process and amplify the electrical signal, the signal processing unit being adaptable to different auditory situations by at least one adjustable parameter that can be automatically adjusted dependent on the line signal, wherein one of the auditory situations is a display auditory situation and is selected whenever the hearing aid device is in the presence of a powered display and is deselected when the hearing aid device is not in the presence of a powered display; and an output transducer to transduce the processed electrical signal into an acoustic or mechanical output signal.

2. The hearing aid device according to claim 1, further comprising:

a threshold value, wherein a signal strength of the line signal can be detected and compared with the threshold value to automatically adjust the parameter upon exceeding the threshold value.

3. The hearing aid device according to claim 1, further comprising:

an adjustable threshold value, wherein a signal strength of the line signal can be detected and compared with the threshold value to automatically adjust the parameter upon exceeding the threshold value.

4. The hearing aid device according to claim 1, further comprising:

an automatic parameter adjustment mechanism configured such that the parameter can be adjusted dependent upon the line signal frequency of the line signal, an automatic adjustment of the parameter ensuing when the line signal frequency exhibits a particular values or lies within a particular value interval.

5. The hearing aid device according to claim 4, further comprising:

an adjustment mechanism permitting adjustment of the value or the value interval.

6. The hearing aid device according to claim 1, wherein the screen device is a television device and the detector is configured to detect a line signal output by the television device.

7. The hearing aid device according to claim 1, wherein the parameter can automatically be adjusted given a detected said line signal, and the parameter can be set back to its original value when the line signal can no longer be detected.

8. A hearing aid device, comprising:

at least one input transducer configured to acquire an input signal and transduce it into an electrical signal;

a detector for detecting a line signal that deflects an electron beam generated in an image tube output by a screen device that is devoid of any information encoded specifically for the hearing aid device;

a signal processing unit configured to process and amplify the electrical signal, the signal processing unit being adaptable to different auditory situations by at least one adjustable parameter that can be automatically adjusted dependent on the presence of the line signal, wherein one of the auditory situations is a display auditory situation and is selected whenever the hearing aid device is in the presence of a powered display and is deselected when the hearing aid device is not in the presence of a powered display; and an output transducer to transduce the processed electrical signal into an acoustic or mechanical output signal;

wherein the screen device is a television device and the detector is configured to detect the presence of line signal output by the television device; and wherein an automatic adjustment of the parameter ensues when the line signal frequency is 15.625 KHz or 15.734 KHz.

9. A method for operating a hearing aid device, comprising:

providing at least one input transducer, a detector; a signal processing unit, and an output transducer of the hearing aid device;

acquiring an input signal with the input transducer and converting it into an electrical signal;

detecting a line signal that deflects an electron beam generated in an image tube output by a screen device with the detector that is devoid of any information encoded specifically for the hearing aid device;

amplifying the electrical signal with the signal processing unit;

automatically adjusting a parameter of the hearing aid device related to an auditory situation of a plurality of auditory situations with the signal processing unit wherein the auditory situation is a display auditory situation when a powered display is present and the auditory situation is an other auditory situation when a powered display is not present;

processing the electrical signal based on the parameter by the signal processing unit; and converting the processed electrical signal into an acoustic or mechanical output signal by the output transducer.

10. A hearing aid device, comprising:

at least one input transducer configured to acquire an input signal and transduce it into an electrical signal;

a detector for detecting a characteristic signal output by a screen device, wherein the characteristic signal is a signal of the screen device inherently defined by a standard for operating the screen device and is devoid of any information encoded specifically for the hearing aid device;

a signal processing unit configured to process and amplify the electrical signal, the signal processing unit being adaptable to different auditory situations by at least one adjustable parameter that can be automatically adjusted dependent on the characteristic signal, wherein one of the auditory situations is a display auditory situation and is selected whenever the hearing aid device is in the presence of a powered display and is deselected when the hearing aid device is not in the presence of a powered display; and an output transducer to transduce the processed electrical signal into an acoustic or mechanical output signal.

11. The hearing device according to claim 10, wherein the screen device is a television device, and the characteristic signal is a signal selected from the group consisting of: a line frequency, a field frequency, and a color signal frequency.

12. A hearing aid device, comprising:

at least one input transducer configured to acquire an input signal and transduce it into an electrical signal;

a detector for detecting solely a presence of a line signal output by a screen device and is devoid of any information encoded specifically for the hearing aid device;

a signal processing unit configured to process and amplify the electrical signal, the signal processing unit being adaptable to different auditory situations by at least one adjustable parameter that can be automatically adjusted dependent on the line signal wherein one of the auditory situations is a display auditory situation and is selected whenever the hearing aid device is in the presence of a powered display and is deselected when the hearing aid device is not in the presence of a powered display; and an output transducer to transduce the processed electrical signal into an acoustic or mechanical output signal.

13. The hearing aid device according to claim 12, wherein the detector detects the presence of the line signal based on either an electromagnetic or an acoustic detection of the line signal itself.

* * * * *